US009238516B2

(12) United States Patent
Termanas

(10) Patent No.: US 9,238,516 B2
(45) Date of Patent: Jan. 19, 2016

(54) SUPPORTED STRAP TWIST DEVICE

(71) Applicant: Premark Packaging LLC, Glenview, IL (US)

(72) Inventor: Jeffrey D. Termanas, Rolling Meadows, IL (US)

(73) Assignee: Signode Industrial Group LLC, Glenview, IL (US)

( * ) Notice: Subject to any disclaimer, the term of this patent is extended or adjusted under 35 U.S.C. 154(b) by 91 days.

(21) Appl. No.: 14/250,952

(22) Filed: Apr. 11, 2014

(65) Prior Publication Data

US 2014/0306054 A1 Oct. 16, 2014

Related U.S. Application Data

(60) Provisional application No. 61/812,583, filed on Apr. 16, 2013.

(51) Int. Cl.

| | |
|---|---|
| ***B65B 13/04*** | (2006.01) |
| ***B65B 13/06*** | (2006.01) |
| ***B65B 13/18*** | (2006.01) |

(52) U.S. Cl.

CPC ..... *B65B 13/06* (2013.01); *B65B 13/18* (2013.01)

(58) Field of Classification Search

CPC ..... B65B 13/06; B65B 13/08; B65B 13/04
USPC ..... 100/25, 26, 31, 33 PB, 34; 242/566, 242/615.3, 615.21, 615.2, 615.4; 53/589
See application file for complete search history.

(56) References Cited

U.S. PATENT DOCUMENTS

| | | | | |
|---|---|---|---|---|
| 5,078,057 | A * | 1/1992 | Pearson | B65B 27/086 100/25 |
| 5,373,686 | A * | 12/1994 | Lang | B65B 13/06 100/26 |
| 7,222,565 | B1 | 5/2007 | Kasel | |
| 2005/0139092 | A1 | 6/2005 | Schuttler et al. | |

FOREIGN PATENT DOCUMENTS

| | | | |
|---|---|---|---|
| EP | 0388761 | A1 | 9/1990 |
| EP | 1783053 | A2 | 5/2007 |
| JP | 2006315746 | A | 11/2006 |

OTHER PUBLICATIONS

International Search Report for PCT/US2014/034008, dated Jul. 1, 2014.

* cited by examiner

*Primary Examiner* — Jimmy T Nguyen
(74) *Attorney, Agent, or Firm* — Levenfeld Pearlstein, LLC

(57) ABSTRACT

A supported strap twist device reorients a strap along a strap path. The device includes an inlet, an outlet and a reorienting section. The reorienting section includes a body having entrance and exit ends and a transition section therebetween. The transition section has a through-bore having a varying cross-sectional shape defining a race. The race has, at a first end, an opposed inwardly pinched circular profile defining a gap. The circular profile thins along the race toward an hour-glass profile, and has, at a second end, an elongated shape. The gap has a substantially constant width along the race. The strap enters the first end at an angle relative to the second end and is reoriented to a desired orientation at the second end. The strap is supported by the race as it traverses therethrough.

17 Claims, 3 Drawing Sheets

Fig. 1
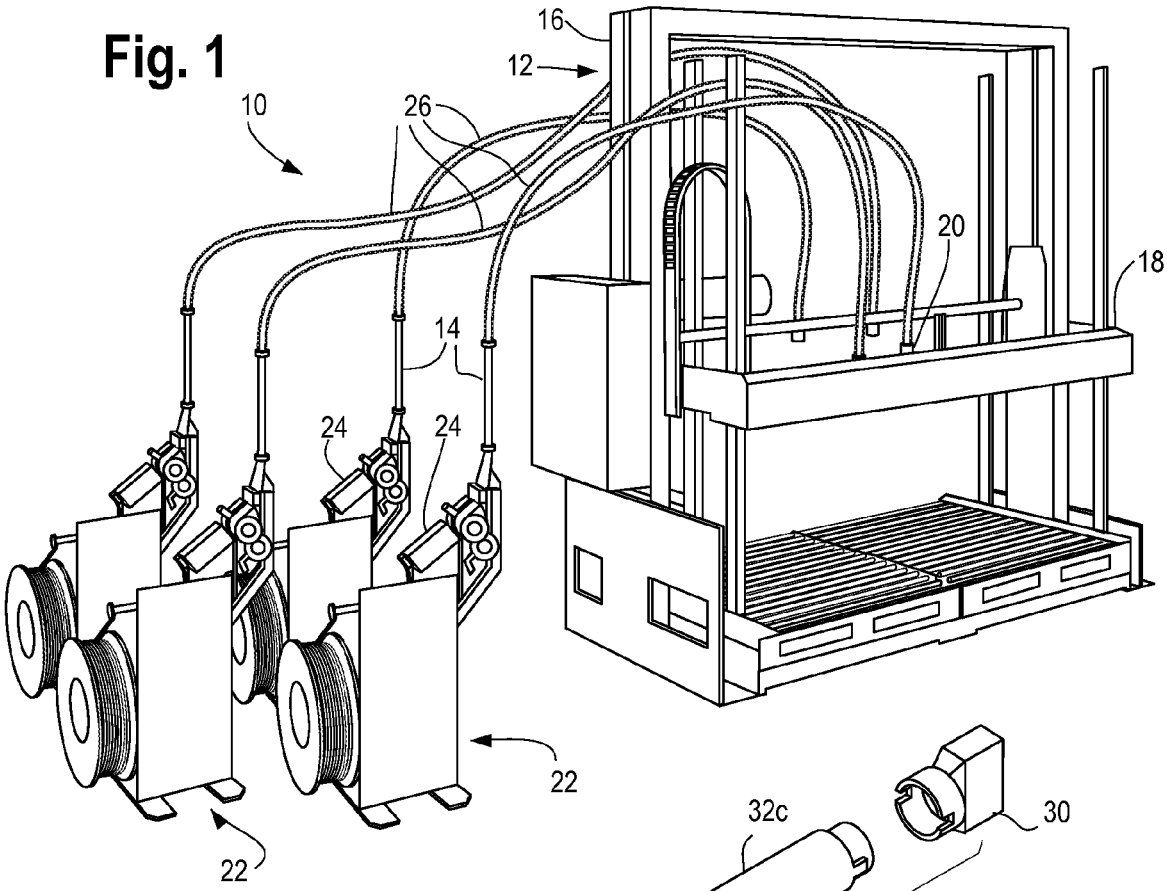
Fig. 2A
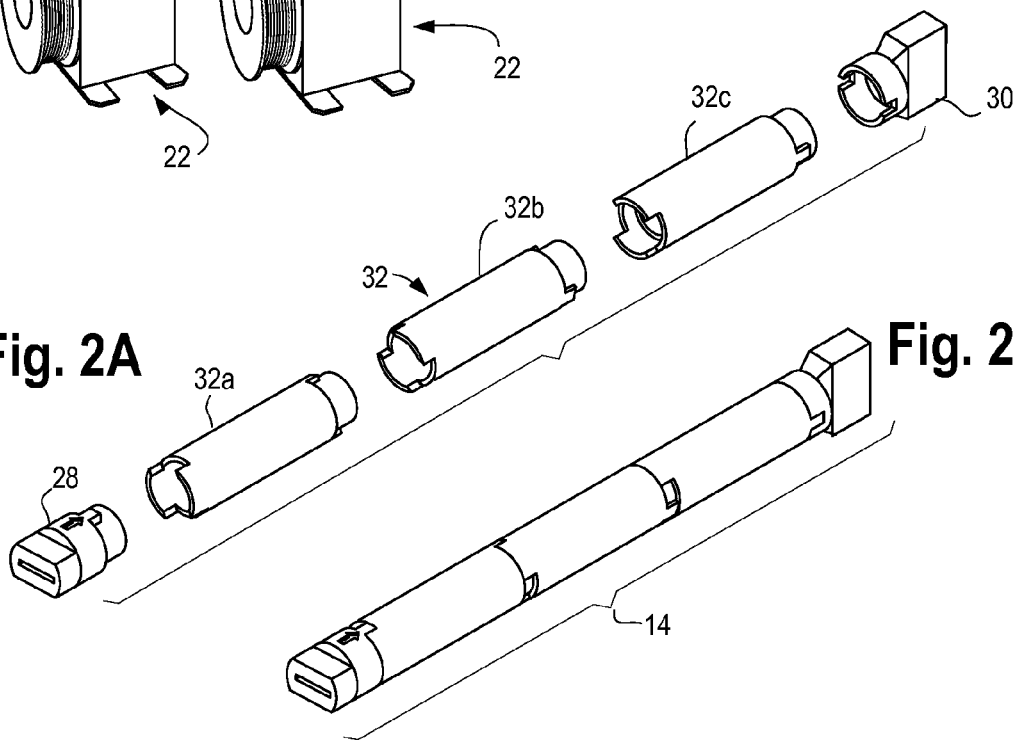
Fig. 2B
Fig. 3
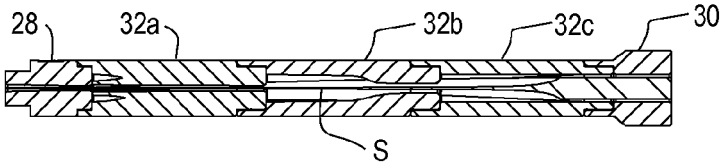

SUPPORTED STRAP TWIST DEVICE

CROSS-REFERENCE TO RELATED APPLICATION DATA

This application claims the benefit of and priority to U.S. Provisional Patent Application Ser. No. 61/812,583, filed Apr. 16, 2013, the disclosure of which is incorporated herein by reference.

BACKGROUND

Strapping machines are in widespread use for securing straps around loads. In one exemplary type of strapping machine, a feed head is positioned at a strap dispenser, located remotely from the sealing head, strap chute and load. That is, portions of the strapping system are separated from one another, rather than incorporated into a unitary machine. One example of such a strapping machine is commercially available from ITW Signode, under the product designation of GCU SmartFlex™. In such an arrangement, the strap dispenser and feed head can be located a significant distance, for example, more than 10 feet, from the sealing head.

In order to assure that the strap is properly conveyed between the feed head and the sealing head, a strap guide extends between these components. The strap guide can be formed as a rectangular tube through which the strap traverses. Such strap guides can be formed from flexible, e.g. polymeric material, to permit relative movement of the sealing head and feed head.

While such strap guides function well, there are situations in which the orientation or direction of the strap must be changed between the feed head and the sealing head. This change in orientation or direction can be particularly problematic when the dispenser/feed head may have to be relocated due to, for example, space or other shop floor constraints.

To carry out the change in orientation or direction of strap, Kasel, U.S. Pat. No. 7,222,565, incorporated herein in its entirety, discloses a twist neck that allows a material, such as strap entering a device in one orientation to be reoriented into a second orientation. For example, the strap can enter the twist neck oriented in a horizontal plane and be reoriented into a vertical plane.

While the twist neck functions well when the strap is being drawn or pulled through the device it has its drawbacks when strap is being conveyed into or pushed through the device. That is, strap can be damaged or can buckle due to the pushing load on the strap. Moreover, the twist neck can only reorient the strap within a certain range of angles.

Accordingly, there is a need for a device that reorients strap through a wide range of orientations and angles. Desirably, such a device can reorient strap when drawn through (i.e., pulled) or conveyed into (i.e., pushed through) the device. More desirably still, such as device can be configured in sections so that a desired reorientation can be carried out gradually, allowing a material to be reoriented without buckling or bending.

SUMMARY

A supported strap twist device includes an inlet, an outlet and a reorienting section having a body having an entrance end, an exit end and a transition section therebetween. The transition section has a through-bore having a varying cross-sectional shape defining a race. The race has, at a first end thereof, an opposed inwardly pinched circular profile defining a gap.

The circular profile thins along the race toward an hourglass profile, and has, at a second end thereof, an elongated shape. The gap has a substantially constant width along the race.

Strap enters the first end at an angle relative to the second end. Strap is reoriented to a desired orientation at the second end. The strap is supported by the race as it traverses therethrough.

The inlet includes an entrance end and an exit end and has a substantially straight through-bore between the entrance and the exit. The inlet is mounted to the reorienting section. The inlet and reorienting sections include mating mounting elements. The mating mounting elements are configured for mounting the inlet and reorienting section to one another at an angle of up to about 30 degrees.

In an embodiment, the mating mounting elements include an elongated circumferential notch and a circumferential boss. The boss is positioned within the notch and is radially movable therein. Preferably, the mounting elements include a pair of elongated circumferential notches and a pair of circumferential bosses.

The outlet includes an entrance end and an exit end and has a substantially straight through-bore between the entrance and the exit. The outlet is mounted to the reorienting section. The outlet and the reorienting sections include mating mounting elements that are configured for mounting the outlet and the reorienting section to one another at a fixed radial orientation. The mounting elements can be the same as or different from those that connect the inlet and reorienting sections.

The device can be configured with multiple reorienting sections mounted to one another between the inlet and the outlet. The reorienting sections can be mounted to one another such that the second ends of the reorienting sections are at an angle to adjacent reorienting sections.

A strap dispenser having a supported strap twist device is also disclosed.

These and other features and advantages of the present disclosure will be apparent from the following detailed description, in conjunction with the appended claims.

BRIEF DESCRIPTION OF THE DRAWINGS

The benefits and advantages of the present disclosure will become more readily apparent to those of ordinary skill in the relevant art after reviewing the following detailed description and accompanying drawings, wherein:

FIG. 1 is an illustration of an exemplary strapping system including an overhead strapping machine and powered strap dispenser having supported strap twist device;

FIGS. 2A and 2B are exploded and assembled views, respectively, of the supported strap twist device;

FIG. 3 is a longitudinal cross-sectional view of the assembled strap twist device;

DETAILED DESCRIPTION

Figure 4B:
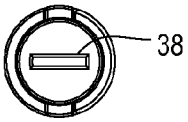
FIGS. 4A-4D are various views of the device inlet.
Figure 5B:
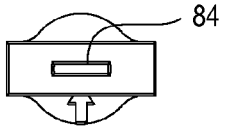
FIGS. 5A-5D are various views of the device outlet.
Figure 4A:
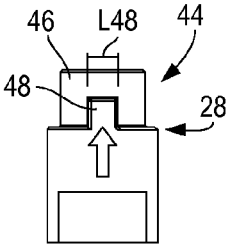
Figure 4D:
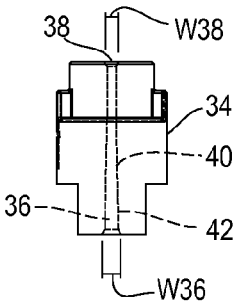
Figure 5A:
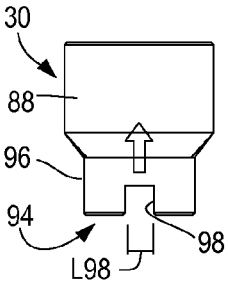
Figure 5D:
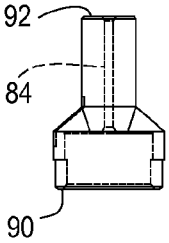
Figure 4C:
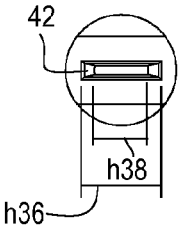
Figure 5C:
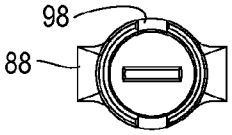

While the present device is susceptible of embodiment in various forms, there is shown in the drawings and will hereinafter be described a presently preferred embodiment with the understanding that the present disclosure is to be considered an exemplification thereof and is not intended to be limited to the specific embodiment illustrated.

Referring now to the figures and in particular to FIG. 1 there is shown a strapping system 10 with art exemplary overhead strapping machine 12 on which the present supported strap twist device 14 is used. The exemplary strapping machine 12 includes a frame 16 that carries a movable overhead carriage 18. One or more sealing heads 20 are mounted to carriage 18.

Strap S is fed to the machine 12 from a dispenser 22. A feed and take up head 24 is mounted to the dispenser 22 to feed strap S to the machine 12 and to and take up/tension the strap S around the load (not shown) during the feed and take up/tensioning cycles, respectively.

The sealing head 20, which is that component on the strapping machine 12 that seals the strap S to itself, is located on the carriage 18. As such, the feed head 24 and the sealing head 20 are located remotely from one another.

A strap guide 26 extends from the feed head 24 to the sealing head 20. A typical strap guide 26 is a rectangular tube in which the strap S is conveyed. The guide 26 is a fairly rigid member so as to support the strap S. The guide 26 is, however, sufficiently flexible to allow the guide 26 to be manipulated so that the dispenser 22 can be moved to, for example, accommodate shop floor needs.

In the illustrated strapping system 10, the supported strap twist device 14 is positioned at about the discharge of the feed head 24, between the feed head 24 and the strap guide 26. The twist device 14 permits reorientation of the strap S as it traverses between the feed head 24 and the sealing head 20 so that the strap guide 26 can be positioned with few if any twists in the guide 26.

Referring to FIG. 2A, there is shown an exploded view of the supported strap twist device 14. The device 14 has an inlet 28, an outlet 30 and one or more reorienting sections 32, which, as shown, can include, for example, three reorienting sections 32 (illustrated as 32*a*, 32*b*, 32*c*). Although the strap S may move in both direction through the device 14, or purposes of the present disclosure, the inlet 28 is that end located near the source (e.g., the feed head 24) and the outlet 30 is that end located adjacent to the strap guide 26.

As seen in FIGS. 4A-4D, the inlet 28 includes a body 34 having an entrance end 36 and an exit end 38. Both the entrance 36 and the exit 38 have substantially rectangular cross-sectional bores 40 through which the strap S traverses. The bore 40 at the entrance 36 is slightly larger in both width $w_{36}$ and height $h_{36}$ dimensions than the width $w_{38}$ and height $h_{38}$ at the exit 38. As such, the walls 42 that define the bore 40 taper inwardly from the entrance 36 to the exit 38. The inlet 28 includes a mounting element 44 for mounting an adjacent reorienting section 32*a* thereto, which reorienting section 32*a* can be mounted to the inlet at varying angles. In a present embodiment, the body 34 includes as collar 46 extending forwardly therefrom with at least one, and in a present embodiment, a pair of circumferential bosses 48 formed on the collar 46. The bosses 48 have a predetermined circumferential length $l_{48}$.

Figure 6A:
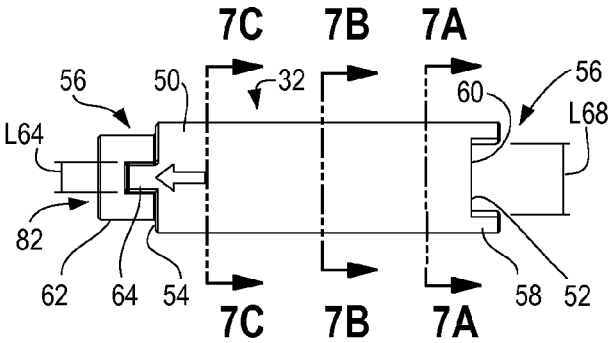
FIGS. 6A, 6B and 6C are side, inlet end and outlet end views, Respectively.
Figure 6C:
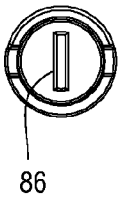
Figure 6B:
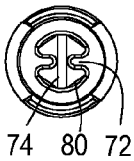

Referring to FIGS. 6A-6C, each reorienting section 32 includes a body 50 having an entrance end 52 and an exit end 54. The entrance end 52 of the first reorienting section 32*a* is mounted to exit end 38 of the inlet 28 and includes a mating mounting element 56. In as present embodiment, the mounting element 56 includes a sleeve 58 that fits over the collar 46 of the inlet 28 and at least one, and preferably a pair of circumferential notches 60 extending along the sleeve 58 that cooperate with the bosses 48. The notches 60 have a circumferential length that is greater than the length $l_{48}$ of the bosses 48 so that the reorienting section 32*a* and the inlet 28 can be rotationally adjusted relative to one another as will be described below.

Figure 7C:
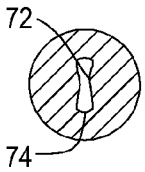
FIGS. 7A, 7B and 7C are sectional views taken along lines 7A-7A, 7B-7B, and 7C-7C of FIG. 6A.
Figure 7B:
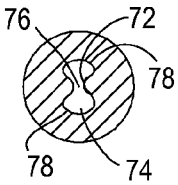
Figure 8:
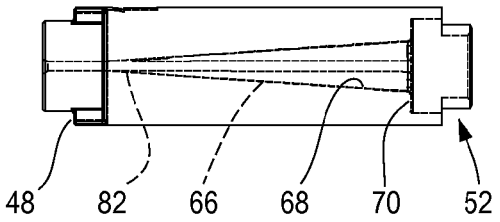
FIG. 8 is a side view showing the taper of the race.
Figure 9:
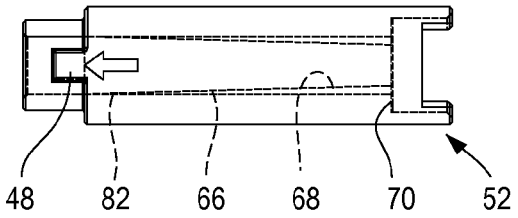
FIG. 9 is a view similar to FIG. 8, rotated 90 degrees showing the race.
Figure 10:
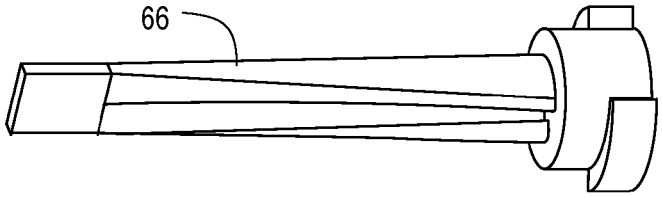
FIG. 10 is a view of the internal cavity formed in the device.

The exit end 54 of each reorienting section 32 is configured similar to the exit end 38 of the inlet 28, and includes a collar 62 extending inwardly therefrom with at least one, and in a present embodiment, a pair of bosses 64 formed on the collar 62. The bosses 64 have a predetermined circumferential length $l_{64}$. The length $l_{64}$ of the bosses 64 is less than the length $l_{60}$ of the notches 60 so that multiple reorienting sections 32 can be joined and rotationally adjusted relative to one another A transition section 66 is adjacent to the reorienting section entrance 52. As seen in FIGS. 7-9, the transition section 66 is defined by a through-bore 68 that changes shape and dimensions along the bore 68. FIG. 10 illustrates an outer wall profile of the transition section 66.

Figure 7A:
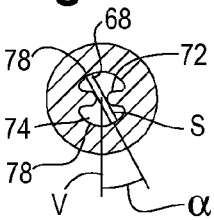

Referring to FIGS. 6B and 7A, an entrance end 70 of the transition section 66 is formed having a pinched circular profile, in which diametrically opposed points or lobes (at the sides of the circle 80) are pinched toward one another (as illustrated at 72) to define a race 74 having a gap 76. The gap 76 is sufficiently wide so that is does not impinge on or prevent movement of the strap S. Rather, the race 74 guides through the strap S transition section 66. The top and bottom 78 of the circle 80 remain open.

The shape of the bore 68 changes along the transition section 66, from the entrance 70 to the exit 82. As seen in FIG. 7B, the top and bottom portions 78 begin to thin out, tending toward an hourglass shape, and as seen in FIG. 7C, the top and bottom 78 further thin toward a generally rectangular cross-section with slightly bulging top and bottom ends (resembling a bow-tie). The gap 76 formed by the pinched sides or lobes 72 at the entrance 70), however, remains about the same along the length of the bore 68. The exit end 82 of the transition section 66, which corresponds to the exit end 54 of the reorienting section 50 has an elongated, almost rectangular cross-sectional shape (although the top and bottom may have a slight bulge as seen in FIG. 7C resembling a bow-tie shape).

Figure 11:
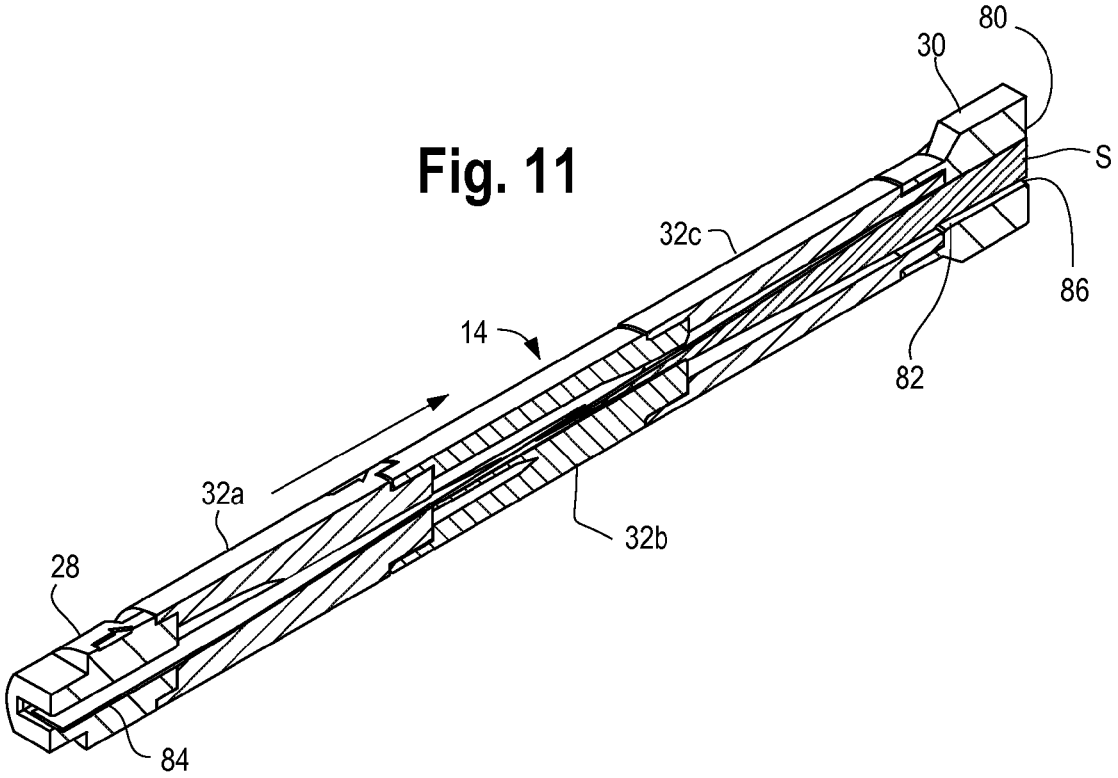
FIG. 11 is a longitudinal sectional illustration of the device, similar to FIG. 3, showing the reorientation of the strap as it traverses through the device.

As seen in FIGS. 2, 3 and 11, multiple reorienting sections 32*a,b,c* can be joined to one another by inserting respective collars 62 into sleeves 58 of adjacent sections. In that the notches 60 are larger than the bosses 64, the circumferential positions of successive reorienting sections 32*a,b,c* can be adjusted to change the orientation of strap S along the length of the strap twist device 14. It will be appreciated from a study of the figures that a section of strap S can enter the device 14 at an angle to the desired exit orientation, and that the shape of the transition section 66 will gradually and smoothly change the orientation of the strap S from the entrance end 70 to the exit end 82. In a present embodiment, the angle $\alpha$ at exit can be as much as 30 degrees relative to the orientation of the strap S at inlet (see, for example, FIG. 7A). That is, the strap S can enter 30 degrees clockwise or counterclockwise from the desired exit orientation.

For example, referring briefly to FIG. 7A, if the strap S enters the race 74 at the angle $\alpha$ (as shown), as it traverses through the section illustrated at FIG. 7B, the strap S will angle upward (toward the vertical V), and farther along, as the strap S traverses the section illustrated in FIG. 7C, it will angle farther upward toward and to the vertical.

It will also be appreciated that multiple reorienting sections 32 can provide for gradual and smooth reorientation to any desired angle. For example, as seen in FIG. 11, using three reorienting sections 32*a,b,c* the strap S can be reoriented 90 degrees from a horizontal orientation (as indicated at 84) to a vertical orientation (as indicated at 86) as it traverses through the device 14.

It will also be appreciated that because the race 74 is defined by the inwardly pinched sides or lobes 72, the strap S is supported throughout its travel through the reorientation section 32 by contact with the inwardly pinched sides or lobes 72. This reduces the likelihood that the strap S will buckle, fold over itself or be subject to an undesired twist as it traverses forward and backward (i.e., in the feed and take-up directions) during machine 12 operation.

The twist device outlet 30 is mounted to the exit end 82 of the last reorienting section, for example, 32*c*. The outlet 30 includes a body 88 having an entrance end 90, an exit end 92, and a straight-through rectangular cross-section bore 84 that is aligned with the exit end 82 of that reorienting section 32*c*.

The outlet 30 includes a mounting element 94 for mounting an adjacent reorienting section 32*c* thereto at a predetermined, fixed radial orientation or angle such that the entrance end 90 is aligned with the exit end 82 of the adjacent reorienting section 32*c*.

In a present embodiment, the body 88 includes sleeve 96 extending rearwardly therefrom with at least one, and in a present embodiment, a pair of circumferential notches 98 formed in the sleeve 96. The notches 98 have a predetermined circumferential length $l_{98}$ to accommodate bosses 64 from the adjacent reorienting section 32 at a fixed orientation. The outlet 30 is configured to facilitate mounting the twist device 14 to a strap guide 26 or other conveyance element for the strap S.

It will be appreciated by those skilled in the art that the relative directional terms such as sides, top, bottom, upper, lower, rearward, forward, and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, arty reference to plural items shall, where appropriate, include the singular. Further, any object modified by the word "associated" shall be construed so that it is not an element of the claim, but rather an object that is acted upon or used by the elements of the claim.

From the foregoing it will be observed that numerous modifications and variations can be made to the device without departing from the true spirit and scope of the novel concepts of the present disclosure. It is to be understood that no limitation with respect to the specific embodiments illustrated is intended or to be inferred. The disclosure is intended to cover all such modifications as fall within the scope of the claims.

What is claimed is:

1. A supported strap twist device, comprising:

an inlet;

an outlet; and a reorienting section having a body having an entrance end, an exit end and a transition section therebetween, the transition section having a through-bore having a varying cross-sectional shape defining a race, the race having, at a first end thereof, an opposed inwardly pinched circular profile, in which diametrically opposed lobes are pinched toward one another to define a gap, top and bottom portions of the circular profile thinning out along the race toward an hourglass shape, and top and bottom portions of the hourglass shape further thin toward an elongated shape at a second end thereof, the gap having a substantially constant width along the race, wherein strap enters the first end at an angle relative to the second end, and wherein the strap is reoriented to a desired orientation at the second end, the strap being supported by the race as it traverses therethrough.

2. The supported strap twist device of claim 1 wherein the second end has a near-rectangular shape.

3. The supported strap twist device of claim 1 wherein the inlet includes an entrance end and an exit end and has a substantially straight through-bore between the entrance end and the exit end, and wherein the inlet is mounted to the reorienting section.

4. The supported strap twist device of claim 3 wherein walls that define the substantially straight through-bore between the entrance end and the exit end have an inward taper from the entrance end to the exit end.

5. The supported strap twist device of claim 3 wherein the inlet and the reorienting section include mating mounting elements, the mating mounting elements configured for mounting the inlet and the reorienting section to one another at an angle of up to about 30 degrees.

6. The supported strap twist device of claim 5 wherein the mating mounting elements include at least one elongated circumferential notch and at least one circumferential boss, wherein the boss is positioned within the notch and is radially movable therein.

7. The supported strap twist device of claim 6 wherein the at least one circumferential notch comprises a pair of elongated circumferential notches and wherein the at least one circumferential boss comprises a pair of circumferential bosses.

8. The supported strap twist device of claim 1 wherein the outlet includes an entrance end and an exit end and has a substantially straight through-bore between the entrance end and the exit end, and wherein the outlet is mounted to the reorienting section.

9. The supported strap twist device of claim 8 wherein the outlet and the reorienting section include mating mounting elements, the mating mounting elements configured for mounting the outlet and the reorienting section to one another at a predetermined angle.

10. The supported strap twist device of claim 1 including a second reorienting section mounted between the inlet and the outlet, the reorienting sections mounted to one another such that the second ends of the reorienting sections are at an angle to one another.

11. The supported strap twist device of claim 10 wherein the reorienting sections include mating mounting elements and wherein the mating mounting elements include an elongated circumferential notch and a circumferential boss, wherein the boss is positioned within the notch and is radially movable therein.

12. The supported strap twist device of claim 11 wherein the inlet includes a mating mounting element configured for mounting the reorienting sections to one another at an angle of up to about 30 degrees and wherein the outlet includes a mating mounting element configured for mounting the outlet and the reorienting section to one another at a fixed radial orientation.

13. The supported strap twist device of claim 12 wherein the inlet mating mounting element and the reorienting sections mating mounting elements include an elongated circumferential notch and a circumferential boss, wherein the boss is positioned within the notch and is radially movable therein, and wherein the outlet mating mounting element and its respective reorienting section mating mounting element include a circumferential notch and a mating circumferential boss configured for mounting the outlet and its respective reorienting section to one another at a predetermined angle.

14. A strap dispenser comprising:

a support structure;

a feed head mounted to the support structure; and a supported strap twist device operably mounted to a discharge of the feed head, the supported strap twist device having an inlet, an outlet and a reorienting section having a body having an entrance end, an exit end and a transition section therebetween, the transition section having a through-bore having a varying cross-sectional shape defining a race, the race having, at a first end thereof, an opposed inwardly pinched circular profile in which diametrically opposed lobes are pinched toward one another to define a gap, top and bottom portions of the circular profile thinning out along the race toward an hourglass shape, and top and bottom portions of the hourglass shape further thin toward an elongated shape at a second end thereof, the gap having a substantially constant width along the race, wherein strap enters the first end at an angle relative to the second end, and wherein the strap is reoriented to a desired orientation at the second end, the strap being supported by the race as it traverses therethrough.

15. The strap dispenser of claim 14 including a second reorienting section mounted between the inlet and the outlet, the reorienting sections mounted to one another such that the second ends of the first and second reorienting sections are at an angle to one another.

16. The strap dispenser of claim 15 wherein the reorienting sections include mating mounting elements and wherein the mating mounting elements include an elongated circumferential notch and a circumferential boss, wherein the boss is positioned within the notch and is radially movable therein.

17. The strap dispenser of claim 14 wherein the second end has a near-rectangular shape.

* * * * *

UNITED STATES PATENT AND TRADEMARK OFFICE

CERTIFICATE OF CORRECTION

PATENT NO. : 9,238,516 B2
APPLICATION NO. : 14/250952
DATED : January 19, 2016
INVENTOR(S) : Jeffrey D. Termanas It is certified that error appears in the above-identified patent and that said Letters Patent is hereby corrected as shown below:

In the Specification

Column 2, line 52, “having” to read as --having a--.

Column 2, line 60, “Respectively;” to read as --respectively;--.

Column 3, line 14, “art” to read as --an--.

Column 3, line 48, “or” to read as --for--.

Column 3, line 63, “as” to read as --a--.

Column 4, line 5, “as” to read as --a--.

Column 4, line 10, “length” to read as --length I60--.

Column 4, line 16, “inwardly” to read as --forwardly--.

Column 4, line 22, “another” to read as --another.--.

Column 4, line 44, “at” to read as --(at--.

Column 5, line 49, “arty” to read as --any--.

Signed and Sealed this
Tenth Day of May, 2016

Michelle K. Lee

Michelle K. Lee
*Director of the United States Patent and Trademark Office*